United States Patent [19]

Biermann et al.

[11] Patent Number: 4,732,704

[45] Date of Patent: Mar. 22, 1988

[54] MANUAL DISHWASHING LIQUID DETERGENT CONTAINING FATTY ALKYLMONOGLUSIDE

[75] Inventors: Manfred Biermann, Muelheim; Martin Bischoff, Erkrath; Ortburg Guirr, Krefeld; Peter Sandkuehler, Hilden; Harald Schnegelberger, Leichlingen; Karl-Heinz Schmid, Mettmann; Klaus Schumann, Erkrath; Eric Sung, Monheim; Klaus-Dieter Wisotzki, Erkrath, all of Fed. Rep. of Germany

[73] Assignee: Henkel Kommanditgesellschaft auf Aktien, Duesseldorf, Fed. Rep. of Germany

[21] Appl. No.: 898,690

[22] Filed: Aug. 21, 1986

[30] Foreign Application Priority Data

Sep. 25, 1985 [DE] Fed. Rep. of Germany ..... 3534082

[51] Int. Cl.[4] ..... C11D 1/14; C11D 1/83

[52] U.S. Cl. ..... 252/548; 252/550; 252/551; 252/174.17; 252/DIG. 14

[58] Field of Search ..... 252/174.17, 550, 551, 252/558, DIG. 14, 548

[56] References Cited

U.S. PATENT DOCUMENTS

| | | | |
|---|---|---|---|
| 2,941,950 | 6/1960 | Korpi et al. | 252/153 |
| 3,219,656 | 11/1965 | Boettner | 260/210 |
| 3,772,269 | 11/1973 | Lew | 252/174.17 |
| 3,925,224 | 12/1975 | Winston | 252/89 |
| 4,536,318 | 8/1985 | Cook et al. | 252/174.17 |
| 4,565,647 | 1/1986 | Llenado | 252/354 |
| 4,599,188 | 7/1986 | Llenado | 252/174.17 |
| 4,668,422 | 5/1987 | Malik et al. | 252/174.17 |

FOREIGN PATENT DOCUMENTS

| | | | |
|---|---|---|---|
| 70076 | 1/1983 | European Pat. Off. . | |
| 2732734 | 1/1978 | Fed. Rep. of Germany . | |
| 2139243 | 11/1984 | United Kingdom | 252/174.17 |

*Primary Examiner*—Prince E. Willis

*Attorney, Agent, or Firm*—Ernest G. Szoke; Henry E. Millson, Jr.; Real J. Grandmaison

[57] ABSTRACT

The foaming and detergent power of manual dishwashing detergents gentle to the skin and containing anionic surfactants of the sulfonate or sulfate surfactant type, fatty acid alkanolamides and fatty alkylglucosides are enhanced by using fatty alkyl $C_{12}$–$C_{14}$ monoglucosides containing less than 2 glucose units per fatty alkyl group in quantities of from 3 to 20% by weight alkyl sulfate or alkylether sulfate, and from 1 to 15% by weight fatty acid alkanolamide.

7 Claims, No Drawings

MANUAL DISHWASHING LIQUID DETERGENT CONTAINING FATTY ALKYLMONOGLUSIDE

BACKGROUND OF THE INVENTION

1. Field of the Invention

This invention relates to liquid manual dishwashing detergents, and more particularly, to such detergents which are gentle to the skin and combine high foaming power with high detergency.

2. Description of Related Art

Liquid cleaning preparations generally consist of aqueous solutions of synthetic anionic and/or nonionic surfactants and standard additives. They are used in particular for cleaning hard surfaces, for example, glass, ceramic materials, plastics, painted and polished surfaces. One important application for liquid cleaning preparations is in the manual washing of crockery and pots and pans. Dishwashing is normally carried out at moderately elevated temperatures of from about 35° to 45° C. in highly dilute cleaning solutions. The detergent power of a cleaning preparation is generally judged by the user to be better, the more vigorously and the longer the suds foam. Because the hands remain in contact with the washing suds for a prolonged period, the compatibility of the detergent with the skin is a particularly important factor in manual dishwashing. For these reasons, the artisan will be guided in the choice of the components and composition of a manual dishwashing detergent by other considerations than for liquid cleaning preparations for other hard surfaces.

It is generally known that alkylether sulfates, i.e., salts of sulfated adducts of from about 2 to 5 moles of ethylene oxide with fatty alcohols containing from about 10 to 18 carbon atoms, and preferably from 12 to 16 carbon atoms, in the aliphatic part, show high foaming and detergent power and are gentle to the skin. Accordingly, commercial manual dishwashing detergents are generally aqueous solutions of alkylether sulfates in conjunction with other surfactants, particularly alkylbenzene sulfonates, solution promoters, dyes and perfumes.

CH-PS No. 354,195 describes liquid manual dishwashing detergents containing a combination of an alkylether sulfate and a nonionic surfactant of the fatty acid-alkanolamide type of mono- or dialkanolamides with no more than 3 carbon atoms in each alkanol group of saturated $C_{10}$–$C_{14}$ fatty acids together with water, solution promoters, dyes and perfumes.

It is also known from U.S. Pat. No. 3,219,656 that alkyl monoglucosides not only develop a stable foam themselves, but also act as foam stabilizers for other anionic and nonionic surfactants. They are said to be thusly comparable with and, in some cases, slightly better than the fatty acid alkanolamides. However, combinations with such alkanolamides are not described.

U.S. Pat. No. 3,925,224 describes detergency-boosting additives of basically water-insoluble or sparingly soluble surfactants to standard fabric detergents based on water-soluble surfactants. $C_8$ to $C_{24}$ fatty alcohol monoglucosides, inter alia, are proposed as suitable insoluble or sparingly soluble nonionic surfactants.

European Patent Application No. 70 076 describes foaming liquid detergents containing anionic surfactants, alkylglucosides and amine oxides or fatty acid alkanolamides, the alkylglucosides being alkyloligoglucosides containing the glucose unit about 1.5 to 10 times. This value is an average value and also takes into account the presence of alkylmonoglucosides in a corresponding proportion.

Alkylglucosides having a degree of oligomerization of higher than 2 are said to be particularly suitable.

3. Description of the Invention

It has now surprisingly been found that the foaming and detergent power of liquid detergents which are specifically designed for manual dishwashing and which contain synthetic anionic surfactants of the sulfonate and/or sulfate type, fatty acid alkanolamides and fatty alkylglucosides may be enhanced by selecting fatty alkylglucosides of the fatty alkylmonoglucoside type. In the context of the invention, fatty alkylmonoglucosides are understood to be compounds containing on average less than two glucose units per fatty alkyl group, more especially those containing from 1 to 1.4 glucose units. The fatty alkyl group contains from 10 to 18 carbon atoms and, in particular, essentially 12 to 14 carbon atoms. In the context of the invention, "fatty alkyls" are understood to be the residues of the fatty alcohols produced by hydrogenation of natural fatty acids, which are completely or predominantly saturated or which even contain unsaturated fractions.

Other than in the operating examples, or where otherwise indicated, all numbers expressing quantities of ingredients or reaction conditions used herein are to be understood as modified in all instances by the term "about".

In one preferred combination, an alkylsulfate or an alkylether sulfate is used as the synthetic anionic surfactant. In the combination of these sulfate surfactants with the fatty acid alkanolamide and the fatty alkylmonoglucoside, the invention provides a detergent containing three different types of surfactants, wherein the hydrophobic part thereof is produced entirely from renewable fatty raw materials. In the case of the alkylglucosides, the hydrophilic part of the molecule also consists of a renewable raw material, i.e., sugar. In the preferred embodiment of the invention, therefore, anionic surfactants having a petrochemical base, particularly alkylbenzene sulfonate, are not used.

The alkylsulfates or alkylether sulfates preferably used are of the commercially available type and contain a linear aliphatic $C_{12}$–$C_{18}$, and preferably $C_{12}$–$C_{14}$ group. The associated cation is preferably an alkali metal or ammonium ion. In the case of the alkylether sulfates, the degree of ethoxylation is from 1 to 5 moles of ethylene oxide. The use of an alkylether sulfate mixture consisting of 50% by weight of a $C_{12}$ alkylether sulfate and 50% by weight of a $C_{14}$ alkylether sulfate containing from 1 to 5, and preferably from 2 to 4, moles of ethylene oxide instead of the alkylether sulfate mixture normally used which contains the same components in a ratio by weight of 70:30, is advantageous because it leads to a reduction in skin irritation without affecting the well-known high detergent power of these surfactants. Small additional quantities of alkylether sulfates containing less than 12 or more than 14 carbon atoms in the alkyl group have very little effect on these favorable results, but should nevertheless be avoided as far as possible.

The alkyl and alkylether sulfates are used in a quantity of from 2 to 25% by weight, and preferably in a quantity of from 3 to 20% by weight, based on the weight of the detergent.

The fatty acid alkanolamides used in the instant detergent contain a $C_8$–$C_{18}$ and preferably $C_{10}$–$C_{14}$ alkyl group in the fatty acid residue, while the amide group is substituted either by two $C_1$–$C_3$ hydroxyalkyl groups, e.g., dialkanolamide or by one such hydroxyalkyl group and by one hydrogen or a $C_1$–$C_3$ alkyl group. Mixtures of fatty acid monoalkanolamides and dialkanolamides are preferably used. These compounds are used in a quantity of from 1 to 15% by weight, and preferably in a quantity of from 1 to 5% by weight, based on the weight of the detergent.

the alkylmonoglucosides employed in accordance with this invention are used in quantities of from 2 to 25% by weight, and preferably in quantities of from 3 to 20% by weight based on the weight of the detergent as a whole, this quantity preferably being equal to or less than the combined quantity of sulfate surfactant and fatty acid alkanolamide. Suitable solution promoters, for example for dyes and perfume oils, include for example, alkanolamines, polyols, such as ethylene glycol, 1,2-propylene glycol, and glycerol, while suitable hydrotropes include alkali metal lower alkylbenzene sulfonates containing from 1 to 3 carbon atoms in the alkyl group, preferably sodium cumene sulfonate. They are used in quantities of from 3 to 15% by weight, based on the weight of the detergent as a whole.

In addition, solvents such as low molecular weight alkanols containing from 1 to 4 carbon atoms in the molecule, preferably ethanol and isopropyl alcohol, are generally used. These solvents are also used in quantities of from 3 to 15% by weight, based on the weight of the detergent as a whole. Thickeners, such as urea, sodium chloride, ammonium chloride and magnesium chloride may also be used herein either individually or in combination. Other standard optional additives include corrosion inhibitors, preservatives, dyes and perfume oils.

The remainder of the detergent composition to a total of 100% by weight comprises water.

In the following examples, the liquid detergents according to the invention were prepared by stirring the individual constituents together and allowing the mixture to stand until it is free from bubbles. The anionic surfactants used in the examples are the sodium salts thereof.

EXAMPLE I

The saucer test is described in this example. 9 grams of sodium $C_{12}$–$C_{14}$ alkyl ether sulfate containing 2 moles of ethylene oxide were stirred with 7.5 grams of sodium cumene sulfonate in 68.5 grams of water at room temperature, after which 12 grams of $C_{12}$–$C_{14}$ alkylmonoglucoside containing 1.3 glucose units in the molecule, 2 grams of $C_{12}$–$C_{14}$ fatty acid monoethanolamide and 1 gram of $C_{12}$–$C_{14}$ fatty acid diethanolamide were successively added in any order with continued stirring. The product was a clear liquid and had a Hoppler viscosity at 20° C. of 15 mPa.s. To test detergency, saucers were coated with 2 grams of molten beef tallow (test soil A) and correspondingly with 2 grams of a mixed soil, stirred with water, of protein, fat and carbohydrates (MiNO-1, Henkel) (test soil B). 8 Liters of tapwater (German hardness 16° d) at 45° C. were then poured into a bowl. To wash the saucers soiled with test soil A, 4 grams, i.e., 0.5 g/l, of the prepared detergent were added and the saucers washed. 18 Saucers could be washed clean before the foam of the initially high-foaming washing solution disappeared. When the alkylmonoglucoside was left out of the detergent composition and the alkylether sulfate content was increased to 21 grams, a detergent was obtained whereby only 14 saucers could be washed under comparable conditions. Further, only 10 saucers could be washed with a detergent composition containing 2 grams of the alkylmonoglucoside and no alkylether sulfate. In the washing of saucers soiled with test soil B, 34 saucers could be washed clean as opposed to 25 or 22 when using only 0.4 grams detergent per liter of water.

EXAMPLE II

6 Compositions differing with respect to the alkylether sulfate and alkylglucoside content, but having the same $C_{12}$–$C_{14}$ fatty acid diethanolamide content, were prepared in the same way as in Example I. Products containing 1.1 glucose units and 2.2 glucose units were compared as alkylglucosides. The detergents were each subjected to the saucer test, wherein the results are set out in the following table 1 and show the advantage of the product containing 1.1 glucose units.

TABLE 1

Saucer Test
(1) $C_{12}$–$C_{14}$ alkylmonoglucoside containing 1.1 glucose units
(2) $C_{12}$–$C_{14}$ alkyloligoglucoside containing 2.2 glucose units

| Quantities in %/wt. | | | Test Soil A (Beef tallow) | | Test Soil B (MiNO-1) | |
|---|---|---|---|---|---|---|
| $C_{12}$–$C_{14}$ alkyl-(ether)$_2$sulfate | Glucoside | $C_{12}$–$C_{14}$ fatty acid diethanolamide | Saucer count | detergency in % | Saucer count | detergency in % |
| | (1) | | | | | |
| 21 | — | 3 | 10 | 67 | 20 | 95 |
| 18 | 3 | 3 | 12 | 80 | 23 | 109 |
| 15 | 6 | 3 | 13 | 87 | 26 | 124 |
| 12 | 9 | 3 | 14 | 93 | 27 | 129 |
| 9 | 12 | 3 | 14 | 93 | 28 | 133 |
| 6 | 15 | 3 | 16 | 107 | 30 | 143 |
| 3 | 18 | 3 | 12 | 80 | 26 | 124 |
| — | 21 | 3 | 7 | 47 | 20 | 95 |
| | | Average value | 12.3 | 81.8 | 24.9 | 119 |
| | (2) | | | | | |
| 21 | — | 3 | 10 | 67 | 20 | 95 |
| 18 | 3 | 3 | 11 | 73 | 22 | 105 |
| 15 | 6 | 3 | 12 | 80 | 22 | 105 |
| 12 | 9 | 3 | 14 | 93 | 23 | 109 |
| 9 | 12 | 3 | 14 | 93 | 22 | 105 |
| 6 | 15 | 3 | 12 | 80 | 21 | 100 |

TABLE 1-continued

| Saucer Test (1) $C_{12}$–$C_{14}$ alkylmonoglucoside containing 1.1 glucose units (2) $C_{12}$–$C_{14}$ alkyloligoglucoside containing 2.2 glucose units | | | | | | |
|---|---|---|---|---|---|---|
| Quantities in %/wt. | | | Test Soil A (Beef tallow) | | Test Soil B (MiNO-1) | |
| $C_{12}$–$C_{14}$ alkyl-(ether)$_2$sulfate | Glucoside | $C_{12}$–$C_{14}$ fatty acid diethanolamide | Saucer count | detergency in % | Saucer count | detergency in % |
| 3 | 18 | 3 | 8 | 53 | 20 | 95 |
| — | 21 | 3 | 5 | 33 | 15 | 71 |
| | | Average value | 10.8 | 71.5 | 20.6 | 98.1 |

EXAMPLE III

The $C_{12}$–$C_{14}$ alkyl(ether)$_2$sulfate of Example I was replaced by $C_{12}$–$C_{14}$ alkyl sulfate, the procedure being as in Example II. The glucosides used were a glucoside containing 1.4 glucose units and another containing 2.2 glucose units. The results are set out in the following table 2 and show that the advantages of using alkylmonoglucosides containing less than 1.5 glucose units are unaffected by the presence of alkyl sulfates.

TABLE 2

| Saucer Test (1) $C_{12}$–$C_{14}$ alkylmonoglucoside containing 1.4 glucose units (2) $C_{12}$–$C_{14}$ alkyloligoglucoside containing 2.2 glucose units | | | | | | |
|---|---|---|---|---|---|---|
| Quantities in %/wt. | | | Test Soil A (Beef tallow, 50° C.) | | Test Soil B (MiNO-1, 40° C.) | |
| $C_{12}$–$C_{14}$ alkyl-sulfate | Glucoside | $C_{12}$–$C_{18}$ fatty acid mono-/diethanolamide (2:1) | Saucer count | detergency in % | Saucer count | detergency in % |
| | (1) | | | | | |
| 21 | — | 3 | 16 | 107 | 25 | 100 |
| 18 | 3 | 3 | 17 | 113 | 29 | 116 |
| 15 | 6 | 3 | 18 | 120 | 31 | 124 |
| 12 | 9 | 3 | 19 | 127 | 32 | 128 |
| 9 | 12 | 3 | 18 | 120 | 35 | 140 |
| 6 | 15 | 3 | 17 | 113 | 39 | 156 |
| 3 | 18 | 3 | 15 | 100 | 40 | 160 |
| — | 21 | 3 | 10 | 67 | 30 | 20 |
| | | Average value | 16.3 | 108.4 | 32.6 | 130.5 |
| | (2) | | | | | |
| 21 | — | 3 | 16 | 107 | 25 | 100 |
| 18 | 3 | 3 | 16 | 107 | 27 | 108 |
| 15 | 6 | 3 | 18 | 120 | 29 | 116 |
| 12 | 9 | 3 | 18 | 120 | 31 | 124 |
| 9 | 12 | 3 | 18 | 120 | 33 | 132 |
| 6 | 15 | 3 | 17 | 113 | 24 | 96 |
| 3 | 18 | 3 | 15 | 100 | 33 | 132 |
| — | 21 | 3 | 10 | 67 | 29 | 116 |
| | | Average value | 16 | 106.8 | 28.9 | 115.5 |

We claim:

1. A liquid manual dishwashing detergent composition comprising from about 2 to about 25% by weight of an anionic surfactant selected from the group consisting of a $C_{12}$–$C_{14}$ alkyl sulfate and a $C_{12}$–$C_{14}$ alkyl ether sulfate, from about 1 to about 15% by weight of a fatty acid alkanolamide, and from about 2 to about 25% by weight of a fatty alkylmonoglucoside containing about 1 glucose unit per fatty alkyl group, based on the weight of said detergent composition.

2. A detergent composition in accordance with claim 1 wherein said fatty alkylmonoglucoside contains from 10 to 18 carbon atoms in the fatty alkyl group.

3. A detergent compsoition in accordance with claim 1 wherein said anionic surfactant contains from 1 to 5 moles of ethylene oxide.

4. A detergent composition in accordance with claim 1 wherein said alkylether sulfate comprises about 50% by weight of a $C_{12}$ alkylether sulfate and about 50% by weight of a $C_{14}$ alkylether sulfate.

5. A detergent composition in accordance with claim 1 wherein said fatty acid alkanolamide contains a $C_8$–$C_{18}$ alkyl group in the fatty acid group.

6. A detergent composition in accordance with claim 1 wherein said fatty acid alkanolamide comprises a mixture of monoalkanolamide and dialkanolamide.

7. A detergent composition in accordance with claim 1 wherein said fatty alkylmonoglucoside is present in said detergent composition in an amount which is equal to or less than the combined quantity of said anionic surfactant and said fatty acid alkanolamide.

* * * * *